United States Patent [19]

Takagi

[11] 4,156,159

[45] May 22, 1979

[54] SELF CROSSED FIELD TYPE ION SOURCE

[75] Inventor: Toshinori Takagi, Nagaokakyo, Japan

[73] Assignee: Futaba Denshi Kogyo Kabushiki Kaisha, Mobara, Japan

[21] Appl. No.: 587,967

[22] Filed: Jun. 18, 1975

[30] Foreign Application Priority Data

Jun. 21, 1974 [JP] Japan ..... 49-71726
Oct. 22, 1974 [JP] Japan ..... 49-128125[U]
Oct. 22, 1974 [JP] Japan ..... 49-128126[U]

[51] Int. Cl.[2] ..... H01J 1/50

[52] U.S. Cl. ..... 313/155; 313/217; 313/231.3

[58] Field of Search ..... 313/155, 217, 231.3, 313/230

[56] References Cited

U.S. PATENT DOCUMENTS 3,969,646 7/1976 Reader et al. ..... 313/155 X

*Primary Examiner*—Rudolph V. Rolinec

*Assistant Examiner*—Darwin R. Hostetter

*Attorney, Agent, or Firm*—Birch, Stewart, Kolasch and Birch

[57] ABSTRACT

An ion source of the electron bombardment type which includes mainly a cathode and an anode confronting the cathode. In order to effect the formation of a magnetic field perpendicular to an electric field established between the cathode and the anode, the anode and/or the cathode is of a particular configuration, more specifically a spiral or helical configuration. A flow of large current is supplied through the anode to establish the magnetic field while application of a given voltage across the cathode produces a multiplicity of electrons. With such an arrangement, movements of charged particles such as electrons or ions are controlled under the influences of the electric and magnetic fields thereby to enhance the production of ions. High temperature operations and simplified implementations become possible because the present ion source itself produces the magnetic field with only a modification of the electrode assembly thereof.

13 Claims, 12 Drawing Figures

FIG. 6
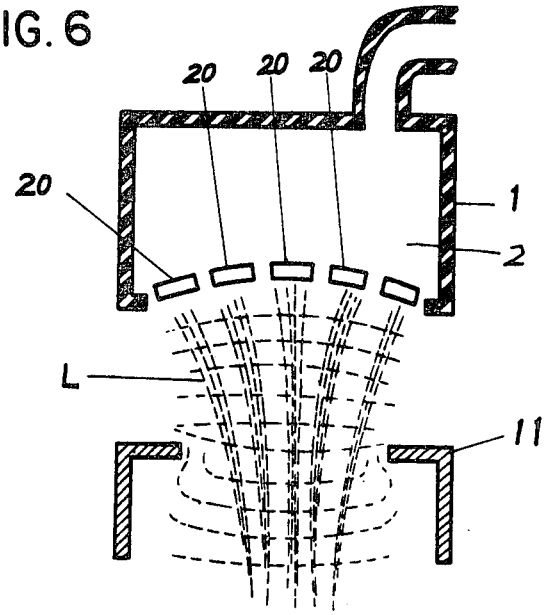
FIG. 7 a
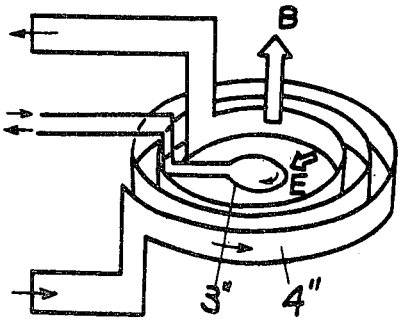
FIG. 7 b
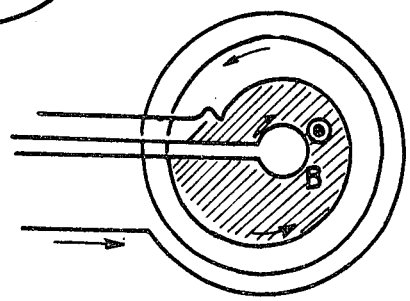
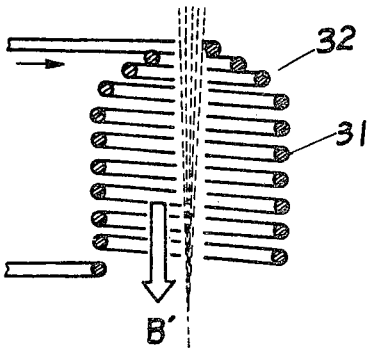
FIG. 8

SELF CROSSED FIELD TYPE ION SOURCE

BACKGROUND OF THE INVENTION

The present invention relates generally to an improvement in ion sources available for producing a number of metal ions.

It is well known in the field of ion sources that electron bombardment ionization behaviors due to gaseous discharge are utilized in a wide range. This is generally termed "electron bombardment type." In this instance, in order to attain efficient utilization of the electron bombardment ionization phenomena, electrons are excited to follow spiral trajectories to increase effective electron path length by application of a magnetic field and an electric field in an orthogonal arrangement.

More specifically, in the conventional ion sources of the electron bombardment type, an ionizable metal material is heated within a metal vaporization furnace provided with a heater and a thermocouple therein. Then, the heated material in the vaporized form is supplied to a discharge chamber wherein voltage is supplied to a filament to produce electrons and also a different voltage is supplied to a cyclindrical anode placed around the filament to establish an electric field between the anode and the filament. Furthermore, a magnetic field perpendicular to the thus established electric field is induced so as to improve ionization efficiency by provision of a magnet coil, thereby permitting electrons to follow spiral trajectories with the resultant increase in electron path length. The provision of the magnet coil is accomplished by winding a fine wire outside the discharge chamber in a spiral configuration. Thereafter, an ion beam is led out through an opening of the discharge chamber in response to application of positive or negative high voltage to an extractor electrode assembly. The ion sources of the electron bombardment type briefly described above, however, have the disadvantages of being large and weighty because of the magnetic coil provided outside the discharge chamber. In addition, other various difficulties are encountered in attaining a magnetic field of high field strength: for example, heat rediation due to Joule heat from the magnetic coil, electric insulation required for high power supply, etc.

Furthermore, when it is desired to ionize metal materials of low vapor pressures and high melting points, the whole of the discharge chamber should be maintained at a predetermined high temperature, this being contrary to the requirement for shielding the magnetic coil against the heat radiation. Operation at high temperatures and high field strength magnetic field is not obtainable in the conventional ion sources employing the magnet coil.

SUMMARY OF THE INVENTION

Accordingly, it is an object of the present invention to provide an improved ion source which itself establishes a magnetic field of high strength for controlling electron movements with no necessity for providing a magnetic coil.

It is another object of the present invention to provide an improved ion source which forms a fully focalized large current ion beam by provision of a plurality of ion source units.

It is still another object of the present invention to provide an ion extractor electrode assembly with capabilities of attaining a high degree of focalization of an ion beam.

Briefly speaking, pursuant to teachings of the present invention, an anode and/or a cathode is of a particular configuration effective to establish a magnetic field perpendicular to an electric field between the two electrodes. Preferably, the anode may be designed and constructed in a spiral configuration to permit a magnetic field of high field strength to develop in the axial direction of the spiral configuration in response to large current flow therethrough. The cathode of the spiral configuration may serve to establish a further magnetic field in the direction as that of the magnetic field due to current flow through the anode to increase the field strength of that magnetic field. As an alternate, the formation of the magnetic field may be accomplished by an additional electrode provided as necessary within an electrode assembly. The magnetic field in combination with the electric field controls movements of charged particles such as electrons and ions so as to promote the generation of ions. The ion source embodying the present invention will be termed "self crossed field type" hereinafter because it itself produces an electric field and a magnetic field crossed with each other at right angles.

BRIEF DESCRIPTION OF THE DRAWINGS

Other objects and many of the attendant advantages of the present invention will be readily appreciated as the same becomes better understood by reference to the following detailed description which considered in conjunction with the accompanying drawings in which like reference numerals designate like parts throughout the figures thereof, and wherein:

FIGS. 3 through 6 are cross sectional views showing other preferred forms of the electrode structure.

FIGS. 7(*a*) and 7(*b*) are perspective and plan views showing the electrode structure illustrated in FIG. 6.

FIG. 8 is a schematic illustration showing a modification of an extractor electrode employed in the ion source of FIG. 1.

DESCRIPTION OF THE PREFERRED EMBODIMENTS

Figure 1:
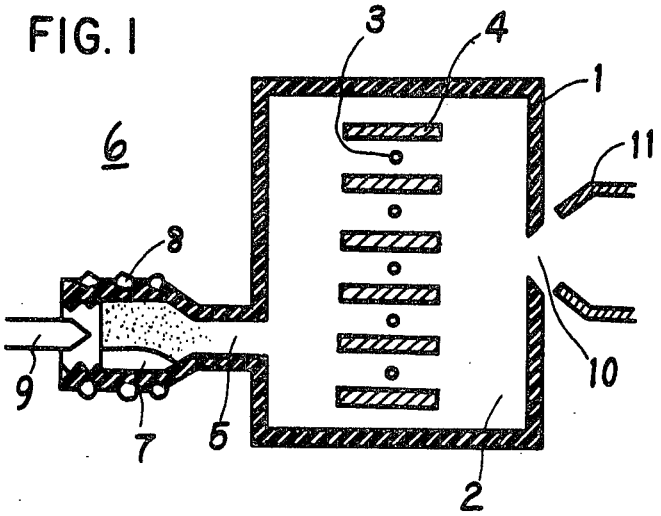
FIG. 1 is a schematic illustration showing one of preferred forms of an ion source constructed in accordance with teachings of the present invention.

Referring now to FIG. 1, there is illustrated one preferred form of an ion source of the self crossed field type embodying the present invention, in which the vaporized or gaseous metal material to be ionized is ionized by electric discharge or electron discharge or electron bombardment. A rectangular enclosure 1 of a proper material defines a discharge chamber 2 in which electron bombardment induced ionization behaviors occur due to gaseous discharge. Mounted in the discharge chamber 2 is an electrode assembly consisting of a filament or cathode 3 and an anode 4 described in detail below in conjunction with FIGS. 2(*a*) and 2(*b*). Pressure in the discharge chamber 2 should be maintained at a desired value suitable for gaseous discharge.

The enclosure 1 has a communication pipe 5 leading to a metal vaporization furnace system 6 for supplying a metal material in the form of vapor. The furnace system 6 includes a source 7 of a given metal material to be ionized, a heating coil 8 available for heating and vaporizing the given metal material, and a thermocouple 9 available for maintaining the furnace temperature at a predetermined one. The metal material is, therefore, supplied in the form of vapor to the discharge chamber 2. The enclosure 1 is further provided with one or more openings 10 at its side wall, through which the ionized metal material passes to a utilization device (not shown) in the form of an ion beam. Closely adjacent the openings there is additional or extractor electrode 11.

Figure 2A:
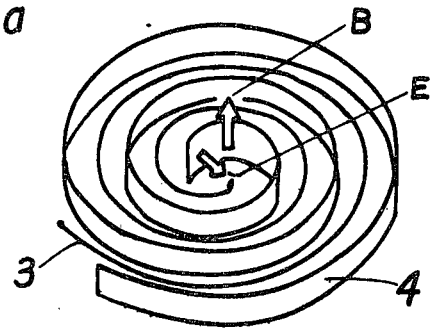
FIGS. 2(*a*) and 2(*b*) are perspective and plan views showing an electrode structure employed in the ion source of FIG. 1.
Figure 2B:
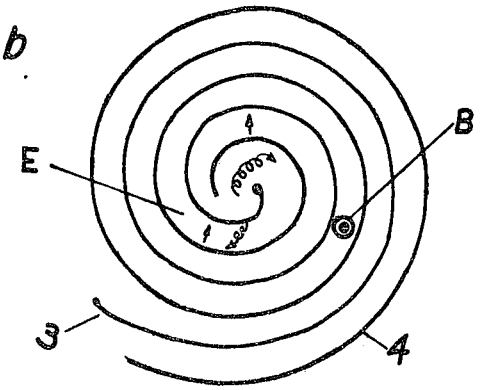

FIGS. 2(*a*) and 2(*b*) illustrate a special configuration of the electrode assembly which plays an important role in the operation of the present ion source.

The filament 3 is made of an electrically conducting wire in the form of a vortex and the anode 4 is spaced against the filament 3 in the form of a similar vortex. It should be noted that the anode 4 is of the width sufficient to permit a flow of large current therethrough. A DC voltage is impressed across both ends of the filament 3 to raise the temperature thereof up to a predetermined value suitable for electron emission. The flow of current through the filament 3 establishes a magnetic field perpendicular to a specified plane including the vortex shaped filament 3 at this instant. In addition, a desired positive DC voltage is supplied to the anode 4 relative to the filament 3, thereby drawing out electrons from the filament 3.

Since the anode 4 represents an extremely low resistance, DC current of low voltage and large current flows through the inside of the anode 4, with a magnetic field B of a high field strength established in the same direction as that of the magnetic field originated due to the current flow through the filament 3. In other words, the magnetic field due to the filament current serves to increase the field strength of the magnetic field. The electrons emitted from the filament 3 proceed toward the anode 4 in spiral trajectories, as schematically illustrates in FIG. 2*b* by arrows under control of a combination of the high strength magnetic field B and an electric field E which is established between the filament 3 and the anode 4 maintained at a positive high voltage relative to the filament 3. The result is that gaseous atoms or molecules are ionized effectively and efficiently.

Moreover, since pursuant to the present invention metal materials of high melting points and low resistances may be employed to constitute the anode 4 thereby to permit a flow of a considerably large current through the anode 4, any restrictions will not be placed on the operating temperature unless the melting point of the material constituting the anode is exceeded. Thus, a requirement for providing a thermal shield between the discharge chamber and the external magnetic coil as discussed in the description of the prior art is avoided.

Figure 3:
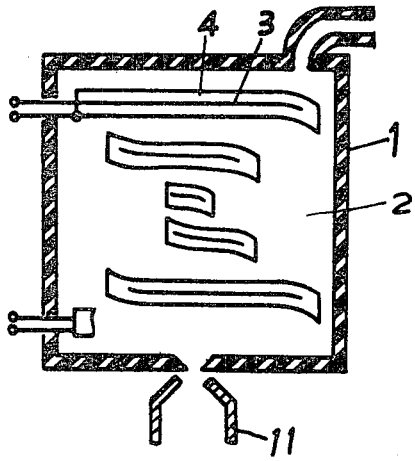

Another embodiment is illustrated in FIG. 3, wherein the filament 3 and the anode 4 are in a parallel spaced relationship and are designed and constructed in a spiral configuration, with the outer diameter depicting a centrally constricted tapered shape. This facilitates power supply from outside of the vacuum vessel chamber 2.

Figure 4:
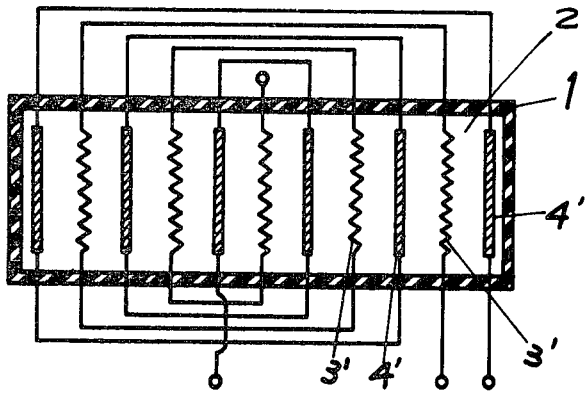

Still another embodiment is illustrated in FIG. 4. Anode constituting segments 4' and filament constituting segments 3' are arranged in an alternate fashion within the chamber 2. External lead wires are provided in a spiral configuration outside the envelope 1, keeping in electrical engagements with the respective segments 3' and 4'.

Figure 5:
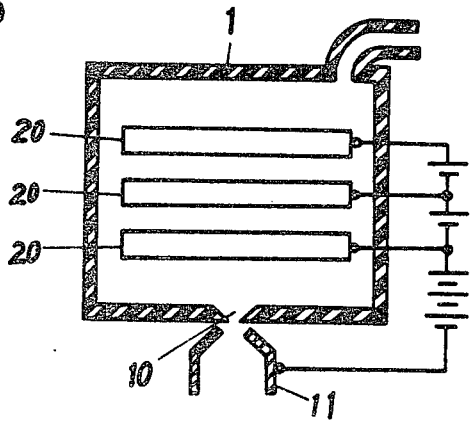

Another embodiment as illustrated in FIG. 5 comprises a stack of units 20 each having the combined spiral filament 3 and spiral anode 4 as illustrated in FIG. 2. If the potential differences among the adjacent units are stepped down as suggested in FIG. 5, the ions will be accelarated toward the units 20 held at lower potentials due to these potential differences and finally arrive at the opening 10. In this instance all the magnetic fields formed by the respective units 20 are added incrementally to provide a magnetic field of the high strength. These units 20 may be placed in the horizontal direction rather than the vertical one.

In the meantime, in extracting ions within the vacuum discharge chamber, ion current through a single opening will be restricted by space charges (pursuant to the so-called 3/2 power principle). Thus, large current ions cannot be obtained in the illustrative embodiments previously described. In other words, the opening formed on the vacuum vessel enclosure has no active capability of generating ions.

FIG. 6 suggests one powerful ion source capable of overcoming the shorcomings set forth above. A plurality of the ion source units 20 are mounted within the enclosure 1 in a manner to describe an arc and define an opened wall of the enclosure 1. The curved surface defined by the ion source units 20 and, in other words, an ion extracting region forms a portion of a beam-focusing lens, thereby attaining a much higher degree of beam focalization. L designates equipotential lines of the ion extracting electric field. Each of the ion source units comprises a spirally wound anode 4'' having a given width suitable for allowing the flow of large current, and a loop-shaped filament 3'' placed at the center of the spiral anode 4'' as shown in FIGS. 7(*a*) and 7(*b*). As discussed above, while voltage is supplied across the filament 3'' to generate electrons therefrom, voltage effective to accelerate these electrons is supplied to the anode 4'' together with large current supply thereto. The electric field E between the anode 4'' and the filament 3'' and the perpendicular magnetic field B of high strength induced by large current flow through the anode 4'', serve to control the motions of charged electrons or ions.

FIG. 8 depicts as improvement in an ion extractor electrode with functions of electrostatically focusing and electromagnetically focusing an ion beam. A ribbon-like wire or strip 31 is wound in a spiral configuration to form an improved extractor electrode 32 of a tapered cone shape. The top portion of the extractor 32 is opened and spaced against the opening 10 (FIG. 1).

For example, when it is desired to extract positive ions, the extractor electrode 32 is held at a positive high voltage potential relative to the vacuum vessel enclosure 1 to provide it with electrostatic focalization. If the opposite situation is encountered, the electrode 32 is held at a negative potential. Current flow through the extractor electrode 32 enables electromagnetic focalization in the axial direction of the electrode 32.

Figure 9A:
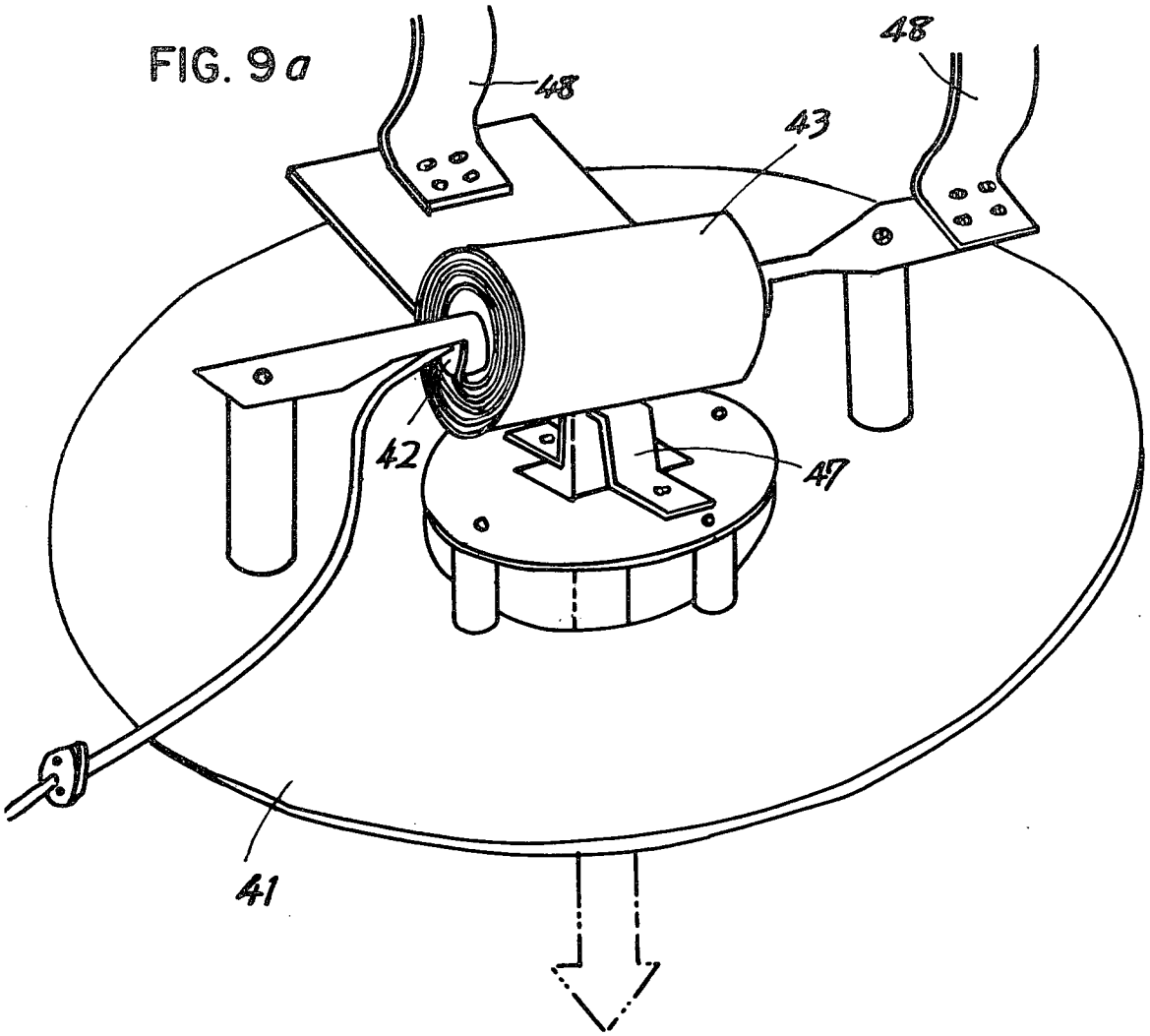
FIGS. 9(*a*) and 9(*b*) are perspective and sectional views showing a practical form of the ion source embodying the present invention.
Figure 9B:
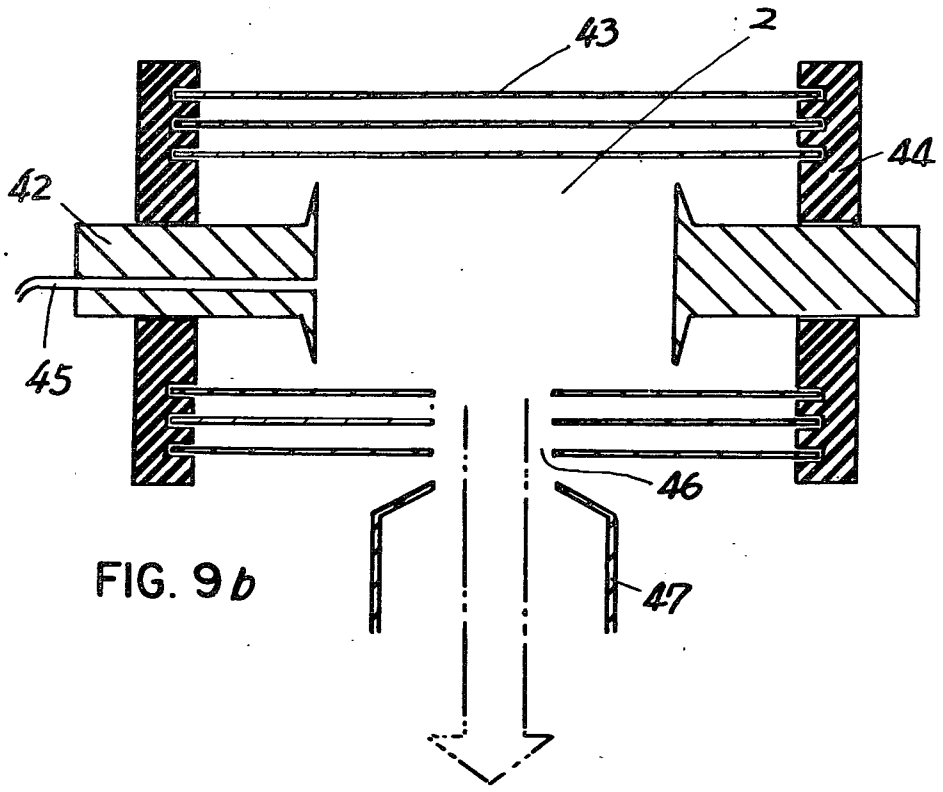

Finally, with reference to FIGS. 9(*a*) and 9(*b*) there is described and illustrated one practical form of self crossed field type ion source constructed in accordance with the present invention for creating a negative ion beam. On a supporting disc 41 is mounted an electrode assembly consisting of a rod-like cold cathode 42 and a spiral shaped anode 43 positioned around the cathode 42. The cathode 42 and the anode 43 may be made of a proper ionizable metal material, for example, such as Cu and Al to serve as a source of ionizable metal which is equivalent of the metal vaporization system 6 of FIG. 1. The both electrodes 42, 43 are supported by a dielectric plate 44 such as ceramics in a manner to define a discharge chamber 2. The inner pressure of the discharge chamber 2 should be held at a desired value suitable for gaseous discharge.

The cathode 42 has a gas introduction opening 45 formed therein to introduce discharge sustaining gas such as He and Ar or negative ion formation facilitating gas such as Cs, whereas the anode 43 has ion beam extracting slits 46 in a position to correspond to an extractor electrode 47 and a pair of current supply terminals 48 provided for the purpose of supplying current flow through the anode 43 thereby establishing a magnetic field. Furthermore, a desired potential difference is developed between the cathode 42 and the anode 43 to establish an electric field which is oriented at right angles to the magnetic field. The extractor electrode 47 may be made of stainless steel. It will be noted that the ion beam is derived from the discharge chamber in a direction perpendicular to the axial direction of the magnetic field, differing from the embodiments shown by FIGS. 1 through 7.

Such extracting procedure takes maximum advantage of the characteristic of the present invention that an external magnetic field formation means is avoided between the discharge chamber and the extractor scheme.

In the embodiment illustrated in FIGS. 9(*a*) and 9(*b*), the following conditions were used and found to give satisfactory results; cathode material: Cu, anode material: Cu, extractor material: stainless steel, anode thickness: 1 mm, anode width: 60 mm, anode inner diameter: 20 mm, anode outer diameter: 30 mm, anode slot size: 0.5 mm×10 mm, degree of vacuum: $10^{-1}$–$10^{-3}$ Torr., discharge voltage: 200–1000 volts, discharge current: 10–$10^2$ mA, anode current: 1000 A, magnetic field strength: 1.6 KG (Kilo Gauss).

Although the foregoing description sets forth the formation of the direct current magnetic field by virtue of the direct current flow through the anode 4, an alternating current voltage may be superimposed thereon to change the direct current magnetic field into any desired alternating magnetic field. The leading wires extending from the filament 3 and the anode 4 may be wound outside the discharge chamber in a manner to increase the field strength of the magnetic field.

Some typical application examples of the present ion source will be now described. In theory, the charged particles under the influences of the elecric field and the magnetic field perpendicular to the first named field make the so-called cyclotron movements. As is well known in the art, the electron cyclotron frequency fec is proportional to the strength of the magnetic field, for example, 1 KG at about 3 GHz. Under the condition that magnetic field of the strength of 10–100 KG (Kilo Gauss) is obtainable through the use of the ion source of the present invention, the electron cyclotron frequency fec will assume the values of 30–300 GHz (the wavelength; 1 mm). If such electrons having the cyclotron frequency fec are subject to additional or external electric and magnetic fields, they will be permitted to absorb energy by means of the so-called cyclotron resonance phenomena and therefore to become "hot electrons." This provides a remarkable increase in ionization efficiency.

For example, fec is 3–30 GHz under the magnetic field of 1–10 KG. Therefore, if microwaves of the substantially same frequencies (that is, several GHz—ten and several GHz) are operatively coupled with the present ion source, the microwave energy will be given to the electrons accompanying their cyclotron movements. Thus, a high efficiency ion source may be accomplished by utilization of such microwave radiation.

As an alternate, fec is 3000 GHz (the wavelength; 10 μm) under the magnetic field in the order of $10^4$ KG and the corresponding wavelength is substantially equal to the wavelength 10.6 μm of the conventional $CO_2$ gas laser. Similary, this enables an increase in ionization efficiency by utilization of laser irradiation.

Introduction of external microwave energy or laser beam irradiation in this manner requires no expenditure on implementations.

In the prior art ion sources, the strength of the magnetic field established by the magnetic coil is determinative as a function of products of the amplitude of current and the number of turns, that is, the so-called ampereturns. For example, the field strengths have the values of 200–300 G at 2000 AT and 1–1.5 KG at 10000 AT. An increase in the ampere-turns, of course, requires increase in the current amplitude or the number of turns. Nevertheless, as previously described, pursuant to the present invention, the exothermic problem due to utilization of the magnet coil is avoided. The ion sources of the present invention operate satisfactorily at strong magnetic fields and at high temperatures.

It is obvious that the principle of the present invention is applicable to not only the ion sources of the above described type but also many other devices. By way of example, the system illustrated in FIG. 4 of which the anode is made of suitable materials showing a great faculty of gas absorption, may be adapted to a high capacity getter pump.

While only certain embodiments of the present invention have been described, it will be apparent to those skilled in the art that various changes and modifications may be made therein without departing from the spirit and scope of the invention as claimed.

What is claimed is:

1. An ion source comprising:

a discharge chamber; and an electrode assembly provided within the discharge chamber, the electrode assembly including a cathode and an anode, the anode having a particular configuration effective to establish a magnetic field in response to current flow therethrough, the magnetic field being perpendicular to an electric field which will be established between the cathode and the anode upon establishing a voltage therebetween.

2. An ion source as set forth in claim 1 wherein the cathode consists of a filament cathode having a particular configuration effective to establish a magnetic field in response to current flow therethrough in the same direction as that of the magnetic field established due to the current flow through the anode.

3. An ion source as set forth in claim 1 wherein the anode is shaped in a spiral configuration with a given width for allowing the current flow therethrough.

4. An ion source of the electron bombardment type comprising:

a cathode adapted for producing a number of electrons in response to voltage supply thereto;

an anode of spiral configuration spaced from the cathode and held at a given potential difference relative to the cathode to establish an electric field therebetween; and means for supplying current flow through the spirally configured anode to establish a magnetic field perpendicular to said electric field to permit the electrons from the cathode to make so-called cyclotron movements, the electric and magnetic fields serving to control the movements of the electrons emitted from the cathode in a manner to increase the electron path length.

5. An ion source of the electron bombardment type comprising a vadium vessel enclosure, means for supplying an ionizable metal material in vaporized or gaseous form to the interior of the enclosure, a filament placed within the enclosure for producing a number of electrons, an anode of a spiral configuration placed around the filament within the enclosure and held at a given potential difference relative to the filament to establish an electric field therebetween, means for supplying large current flow through the spiral shaped anode to establish a magnetic field of a high strength in the axial direction perpendicular to the electric field, the electrons from the filament being permitted to follow cyclotron trajectories under the crossed electric and magnetic fields, and an extractor electrode placed outside the enclosure for extracting the metal ions created by virtue of electron bombardment, in the form of an ion beam.

6. An ion source system comprising a plurality of ion source units as set forth in claim 5.

7. An ion source as set forth in claim 5 wherein the anode is made of a metal material of low resistance and high melting point.

8. An ion source as set forth in claim 5 wherein microwave energy radiation is operatively coupled with the interior of the enclosure to produce the cyclotron resonance phenomenon with the electrons accompanying the cyclotron movements.

9. An ion source as set forth in claim 5 wherein laser beam radiation is operatively coupled with the interior of the enclosure to produce the cyclotron phenomenon with the electrons accompanying the cyclotron movements.

10. An ion source as set forth in claim 5 wherein the extractor electrode is made of a strip wound in a spiral configuration with functions of electromagnetically focusing a beam of the ions.

11. An ion source as set forth in claim 1 wherein the anode is made of an ionizable metal material suitable as a source of ionizable metal.

12. An ion source as set forth in claim 1 further comprising means for introducing discharge sustaining gas into the interior of the discharge chamber.

13. An ion source as set forth in claim 5 wherein the ion beam is derived from the enclosure in a direction perpendicular to the axial direction of the magnetic field.

* * * * *